US006845752B2

(12) United States Patent
Jay et al.

(10) Patent No.: US 6,845,752 B2
(45) Date of Patent: Jan. 25, 2005

(54) FUEL INJECTION SYSTEM

(75) Inventors: David C. Jay, Vähäkyrö (FI); Tommy Dahlberg, Vaasa (FI)

(73) Assignee: Wartsila Finland Oy, Vaasa (FI)

( * ) Notice: Subject to any disclaimer, the term of this patent is extended or adjusted under 35 U.S.C. 154(b) by 0 days.

(21) Appl. No.: 10/687,097

(22) Filed: Oct. 15, 2003

(65) Prior Publication Data

US 2004/0079336 A1 Apr. 29, 2004

(30) Foreign Application Priority Data

Oct. 16, 2002 (FI) ..... 20021841

(51) Int. Cl.[7] ..... F02M 51/04
(52) U.S. Cl. ..... 123/381; 417/32; 123/494
(58) Field of Search ..... 123/381, 446–7, 123/494; 417/32, 63

(56) References Cited

U.S. PATENT DOCUMENTS

| | | | | | |
|---|---|---|---|---|---|
| 4,718,391 | A | * | 1/1988 | Rembold | 123/506 |
| 4,869,218 | A | * | 9/1989 | Fehlmann et al. | 123/357 |
| 5,509,392 | A | * | 4/1996 | Schmitz | 123/516 |
| 5,706,780 | A | * | 1/1998 | Shirakawa | 123/381 |
| 5,868,175 | A | * | 2/1999 | Duff et al. | 141/59 |
| 6,102,000 | A | * | 8/2000 | Shindoh et al. | 123/381 |
| 6,196,191 | B1 | * | 3/2001 | Rembold et al. | 123/447 |
| 6,240,901 | B1 | | 6/2001 | Jay | |
| 2003/0221674 | A1 | * | 12/2003 | Scanderbeg et al. | 123/479 |
| 2004/0081560 | A1 | * | 4/2004 | Blumenthal et al. | 417/32 |

FOREIGN PATENT DOCUMENTS

| | | | | |
|---|---|---|---|---|
| EP | 0 316 581 | | 5/1989 | |
| EP | 1 036 923 | | 9/2000 | |
| FR | 0 270 720 | * | 5/1988 | F02M/59/30 |
| JP | 58-133440 | * | 8/1993 | 123/381 |
| JP | 2002 235633 | | 8/2002 | |
| WO | 01/40638 | | 6/2001 | |

OTHER PUBLICATIONS

Patent Abstracts of Japan, vol. 011, No. 050 (M–562), Publication No. 61 212661, published Sep. 20, 1986.
Patent Abstracts of Japan, Publication No. 05–231198, Published Sep. 7, 1993.

* cited by examiner

*Primary Examiner*—Thomas Moulis
(74) *Attorney, Agent, or Firm*—Smith-Hill and Bedell

(57) ABSTRACT

A fuel injection system includes a fuel pressure boost pump having a pump body that defines a pump cylinder and a pump chamber. A piston structure is movable in the pump cylinder along a longitudinal axis of the piston structure. A fuel inlet conduit and a fuel outlet conduit are in flow connection with the pump chamber, the fuel inlet conduit being provided with a first one-way valve and the fuel outlet conduit being provided with a second one-way valve. A temperature sensor is in thermally conductive contact with the pump body.

12 Claims, 2 Drawing Sheets

FUEL INJECTION SYSTEM

BACKGROUND OF THE INVENTION

The present invention relates to a fuel injection system comprising a pressure boost pump having a pump body defining a pump cylinder and a pump chamber, and also comprising a fuel inlet conduit and a fuel outlet conduit in flow connection with the pump chamber, the conduits each having a one-way valve, and further a piston structure (which may be a simple piston member or a more complex apparatus) inside the pump cylinder and movable along the longitudinal axis of the piston structure.

In addition, the invention relates to a method of operating a fuel injection system that comprises a pressure boost pump having a pump body defining a pump chamber and a pump cylinder and also comprising a fuel inlet conduit and a fuel outlet conduit in flow connection with the pump chamber, the conduits each having a one-way valve, and further a piston structure arranged inside the pump cylinder, in which method during the intake stroke of the piston structure fuel flows into the pump chamber and during the power stroke of the piston structure fuel flows away from the pump chamber via the one-way valve in elevated pressure and temperature.

Such fuel pressure boost pumps are commonly used in so-called common rail fuel injection systems. A known common rail fuel injection system is disclosed in the applicant's U.S. Pat. No. 6,240,901. In the known system, fuel is fed from the fuel tank to the pressure accumulator by means of a high pressure pump, subsequent to which the fuel is injected into cylinders of the engine by means of injectors.

A problem with a pump like this is that lateral forces acting on the piston structure of the pump cause wear of the piston structure and increase the risk of seizure.

It is an aim of the present invention to provide a fuel injection system minimizing the problems associated with prior art. It is an especial aim of the invention to provide a capability for efficiently detecting pressure boost pump malfunctions in a so-called common rail fuel injection system.

SUMMARY OF THE INVENTION

In an embodiment of the invention, the fuel injection system comprises a pressure boost pump, in which the pump cylinder and the pump chamber have been arranged in connection with the body part thereof, and a fuel inlet conduit and a fuel outlet conduit in flow connection with the pump chamber, the conduits each having a one-way valve, and further a piston structure arranged inside the pump cylinder, the piston structure being movable along its longitudinal axis. The fuel injection system further comprises a temperature sensor arranged in the body part for monitoring the operation of the pump.

In a preferred embodiment of the invention, the fuel injection system comprises a number of pressure boost pumps, each of which pumps is provided with a temperature sensor, and additionally the system comprises an analysis apparatus for comparing the data read provided by the pressure boost pump temperature sensors. Advantageously the pressure boost pumps are arranged to pump fuel into a functionally common pressure accumulator space.

A method embodying the invention is performed with a fuel injection system comprising a pressure boost pump, in which the pump cylinder and the pump chamber have been arranged in connection with the body part thereof, and a fuel inlet conduit and a fuel outlet conduit in flow connection with the pump chamber, the conduits having a one-way valve, and further a piston structure arranged inside the cylinder, and in accordance with the method during the intake or suction stroke of the piston structure fuel flows into the pump chamber and during the power or pressure stroke of the piston structure fuel flows away from the pump chamber via the one-way valve at elevated pressure and higher temperature and in which method the temperature of the pressure boost pump is measured for monitoring the operation of the pressure boost pump. The temperature of the pressure boost pump is measured using a temperature sensor arranged in connection with the pressure boost pump.

Typically the part in which a malfunction occurs is the one-way valve of the outlet conduit. In the event of a malfunction, this one-way valve may allow fuel to move into and out of the pump chamber. Therefore, the temperature sensor is preferably arranged adjacent the pump chamber or the channel connecting the pump chamber and the one-way valve of the outlet conduit, or, for example adjacent the one-way valve of the outlet chamber so that a temperature increase caused by the above-mentioned malfunction can be detected.

In the event that the system comprises only one pressure boost pump, the rate of change of the measurement data read from the temperature sensor is compared with a setpoint of the rate of change, and in case the measured rate of change exceeds the setpoint, an alarm condition is activated.

If the fuel injection system comprises a number of pressure boost pumps arranged to pump into a functionally common pressure accumulation space and each pump is provided with at least one temperature sensor, and the injection system further comprises an analysis apparatus for comparing the measurement data read from the temperature sensors of the several pressure boost pump, the temperature of each pressure boost pump is read into the analysis apparatus, in the analysis apparatus the temperature of each pressure boost pump is compared with the temperature of at least one other pressure boost pump and if the temperature difference is larger than a setpoint, an alarm condition is activated.

The temperature of each pressure boost pump is regularly read while the fuel injection system is in operation.

BRIEF DESCRIPTION OF THE DRAWINGS

In the following the invention is described by way of example and with reference to the appended drawings, of which

DETAILED DESCRIPTION

Figure 1:
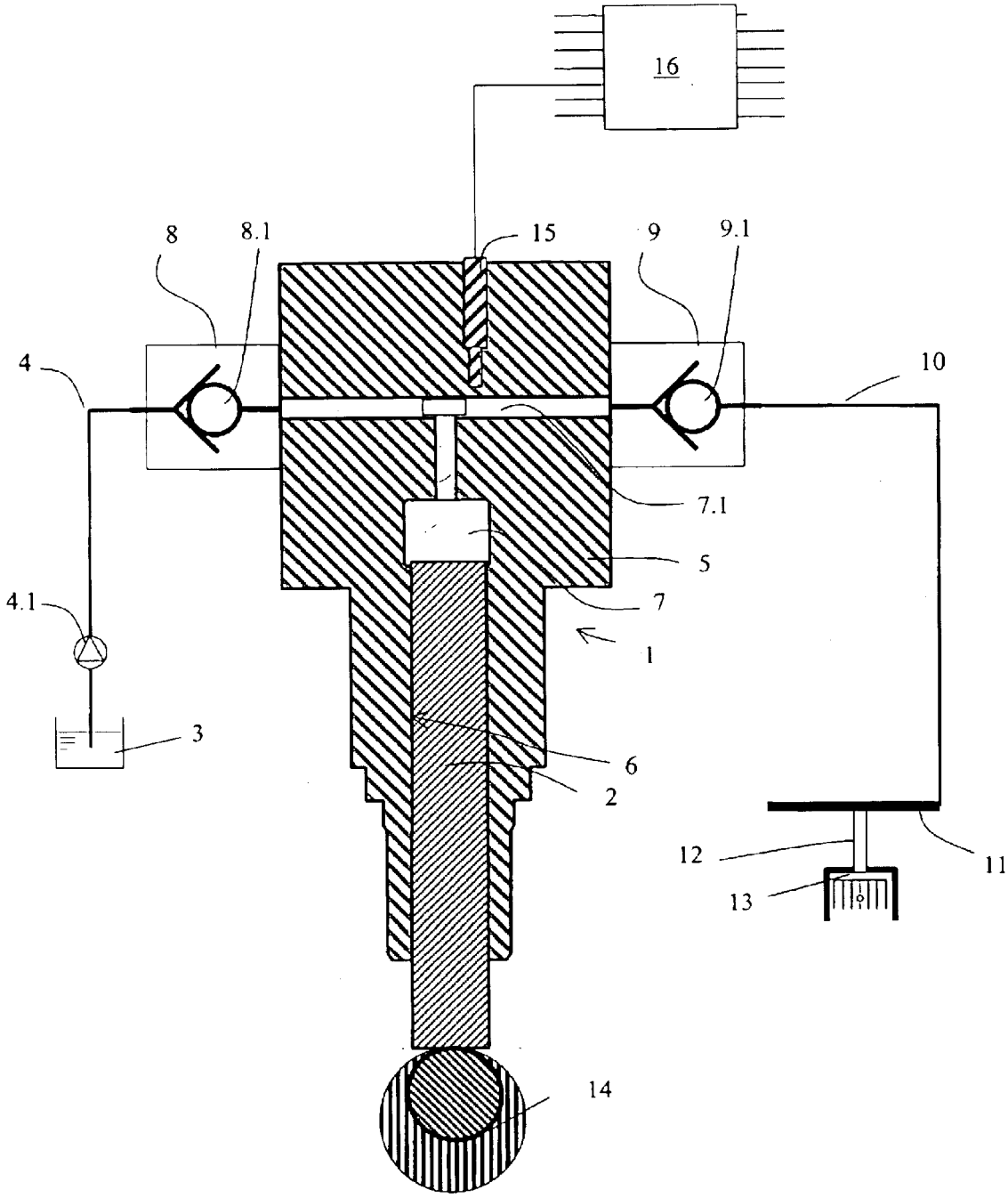
FIG. 1 shows an exemplary embodiment of the fuel pressure boost pump.

In the appended drawings, reference numeral 1 refers to a piston engine fuel pressure boost pump 1 of a fuel injection system. The fuel injection system comprises a source for the fuel, such as a fuel tank 3, to which the fuel pressure boost pump is connected by means of a channel 4 which may be provided with a transfer pump 4.1. The fuel pressure boost pump 1 comprises a body part 5, which defines a pump cylinder 6 and a pump chamber 7. Both a fuel inlet conduit 8 and a fuel outlet conduit 9 are in flow connection with the pump chamber 7. The conduits 8, 9 are provided with respective one-way valves 8.1, 9.1 so that in normal operation the one-way valve 8.1 of the inlet conduit 8 allows fuel to flow into the pump chamber 7 but does not allow it to flow away from the pump chamber 7, and the one-way valve 9.1 of the outlet conduit 9 allows fuel to flow away from the pump chamber 7 but does not allow fuel to flow back to the pump chamber 7. The flow takes place through the channel 7.1 connecting the pump chamber and the one-way valve of the outlet conduit. In a fuel pressure boost pump 1 embodying the invention there further is a piston structure 2 provided inside the cylinder 6, advantageously arranged freely rotatable around its longitudinal axis. Further, the piston structure is functionally connected to the camshaft 14 or a corresponding arrangement for causing its reciprocating movement. During normal operation, as the piston reciprocates in the direction of its longitudinal axis, the one-way valve 8.1 allows fuel to pass from the pump chamber into the pump chamber 7 during the suction stroke, while during the pressure increase stroke the one-way valve 9.1 allows fuel to pass through it into the common pressure accumulator 11. The pressure of the common pressure accumulator is higher, so the pressure of the fuel pump chamber will have to increase sufficiently for the one-way valve 9.1 to open.

The channel 4 transferring fuel from the fuel tank 3 is connected to the inlet conduit 8 from which fuel can flow unidirectionally through the one-way valve 8.1 to the pump chamber 7. From there, fuel is conveyed unidirectionally via the one-way valve 9.1 and the outlet conduit 9 to the fuel transfer channel 10 connecting the pressure boost pump 1 and the common pressure accumulator 11. From the common pressure accumulator 11, fuel is transferred to the engine combustion chamber 13 by means of an injector nozzle 12.

The fuel injection apparatus comprises a temperature sensor module 15, arranged in the body part 5 of the fuel pressure boost pump 1, the temperature sensor module being connected to analysis apparatus 16. Preferably, the temperature sensor module 15 includes a sensor, such as a thermocouple, and an analog-to-digital converter which converts the analog signal to digital form and supplies temperature measurement data to the analysis apparatus 16. It should be understood, however, that other arrangements are possible. For example, the temperature sensor module may include only the sensor, in which case the analog-to-digital converter for converting the analog signal to digital form would be included in the analysis apparatus. Measurement data is regularly read from the temperature sensor module 15 into the analysis apparatus 16 while the engine is in operation. Temperature measurement setpoint data is stored in the analysis apparatus 16 or elsewhere to be used by it, the data being used in monitoring the operation of the fuel pressure boost pump.

During normal operation fuel flows into the pump chamber 7 via the one-way valve 8.1 of the fuel inlet conduit 2 during the intake stroke of the piston structure, and fuel flows at elevated temperature and pressure away from the pump chamber via the one-way valve 9.1 of the outlet conduit 9 into the common pressure accumulator 11 during the power stroke of the piston structure. During this operation the temperature of the fuel pressure boost pump is measured by means of the temperature sensor module 15 to monitor the operation of the one-way valve 9.1 of the outlet conduit 9. The monitoring is based on the observation that if the one-way valve 9.1 malfunctions and allows fuel to flow back to the pump chamber 7, whereby the same fuel is pumped many times back and forth, this sequential pumping back and forth will cause a rapid increase in fuel temperature. This can be detected by means of the analyzing apparatus 16 and necessary actions can be taken.

The apparatus shown in FIG. 1 comprises only one fuel pressure boost pump 1, whereby the rate of change of the measurement data read from the temperature sensor module 15 is compared with the setpoint of the rate of change, stored in the analysis apparatus 16 or available to it somewhere else in the system. If the measured rate of change is larger than the setpoint, predefined alarm procedures are triggered. Such procedures can include, for example alarming the control room of the installation and/or storing the alarm information into the control system.

Figure 2:
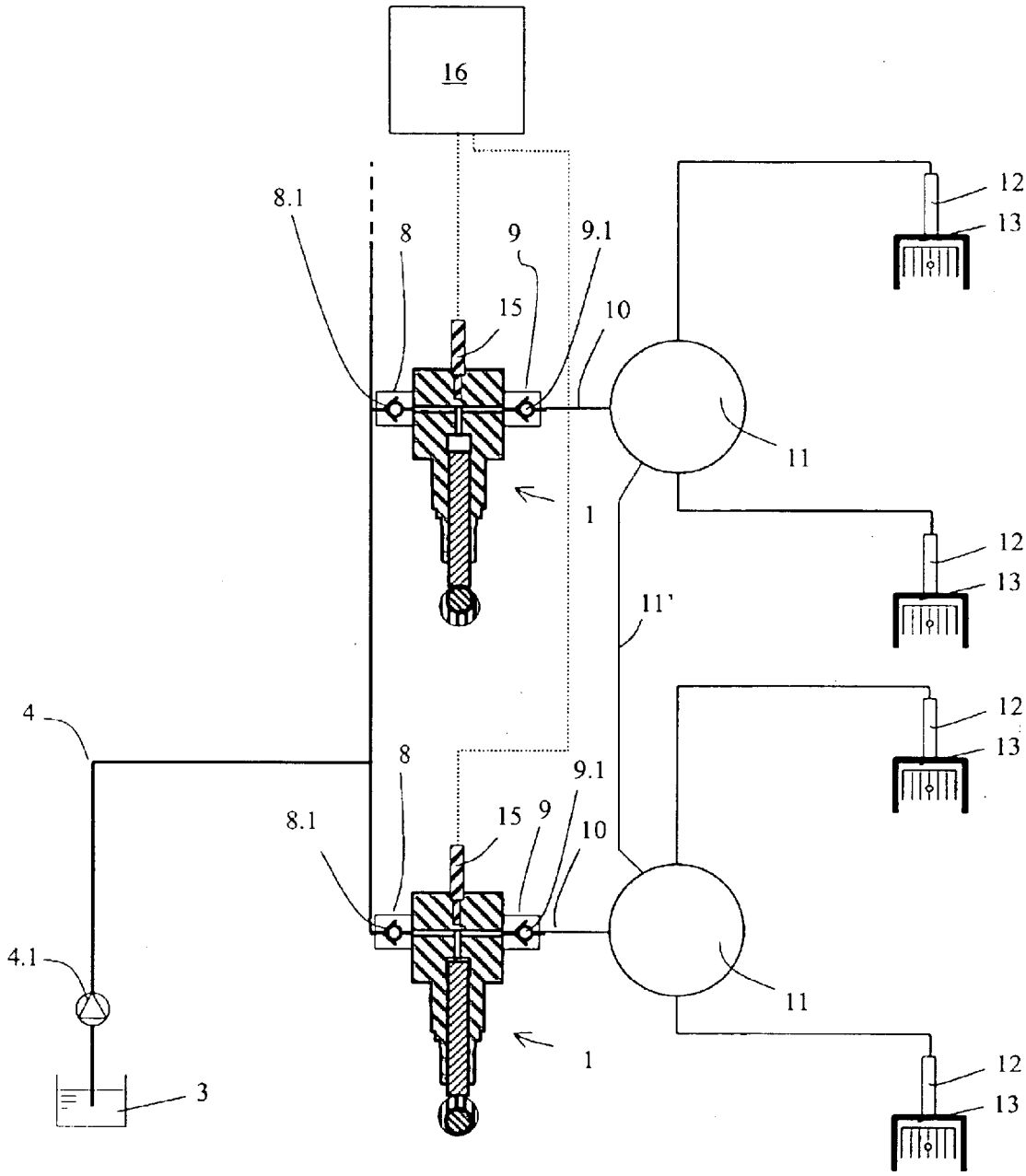
FIG. 2 shows another exemplary embodiment of the fuel pressure boost pump.

In the embodiment shown in FIG. 2 the fuel injection system comprises multiple fuel pressure boost pumps 1 arranged to pump into the respective pressure accumulator vessels 11 that are in flow connection with each other by means of a channel 11', forming a common pressure accumulation space. Connecting the pressure accumulation vessels together in this manner allows the fluctuation of the fuel pressure to be decreased. Each fuel pressure boost pump 1 is provided with at least one temperature sensor module 15. The fuel injection system in this case comprises an analysis apparatus 16 which is electrically connected to each of the temperature sensor modules 15 of the fuel pressure boost pumps 1. Measurement data is continuously read into the analysis apparatus 16 from each of the temperature sensor modules 15 and in the analysis apparatus the temperature of each separate fuel pressure boost pump is compared to that of at least one other fuel pressure boost pump. If the temperature difference is larger than the setpoint stored in the analysis apparatus or somewhere else to be used by it, an alarm condition is triggered.

In a system as that shown in FIG. 2, comprising a number of fuel pressure boost pumps, the sequential temperature measurement data does not necessarily have to be stored, because a fault in the one-way valve 9.1 can be detected by comparing the temperatures read from various locations. The analysis apparatus 16 can be implemented by, for example, the engine control computer or the like.

The invention is not limited to the embodiments described here, but a number of modifications thereof can be conceived of within the scope of the appended claims.

What is claimed is:

1. A fuel injection system for an engine, the fuel injection system comprising:

a fuel pressure boost pump having a pump body that defines a pump cylinder and a pump chamber, a piston structure in the pump cylinder and movable therein along a longitudinal axis of the piston structure, a fuel inlet conduit in flow connection with the pump chamber, the fuel inlet conduit being provided with a first one-way valve, a fuel outlet conduit in flow connection with the pump chamber, the fuel outlet conduit being provided with a second one-way valve, and a temperature sensor in thermally conductive contact with the pump body.

2. A fuel injection system according to claim 1, further comprising a measurement means for receiving a signal generated by the temperature sensor and measuring a characteristic of the signal to provide temperature data, and an analysis apparatus for receiving the temperature data and comparing the temperature data with a threshold value.

3. A fuel injection system according to claim 1, wherein the temperature sensor is located in a bore in the pump body.

4. A fuel injection system according to claim 1, wherein the temperature sensor is located adjacent the pump chamber, or adjacent a channel formed in the pump body and connecting the pump chamber to the fuel outlet conduit, or adjacent the second one-way valve.

5. A fuel injection system according to claim 1, comprising a plurality of fuel pressure boost pumps each having a pump body, and also comprising a plurality of temperature sensors in thermally conductive contact with the pump bodies respectively, a measurement means for receiving signals generated by the temperature sensors respectively and measuring a characteristic of the signals to provide temperature data for the pumps respectively, and an analysis apparatus for receiving the temperature data and comparing the temperature data.

6. A fuel injection system according to claim 5, wherein each pump has a fuel outlet conduit and the system further comprises a means defining a pressure accumulator space to which the fuel outlet conduits are connected.

7. A fuel injection system according to claim 6, wherein the means defining the pressure accumulator space comprises a plurality of pressure accumulator vessels to which the fuel outlet conduits are respectively connected and a pressure equalization conduit connecting the vessels.

8. A method of operating a fuel injection system for an engine, the fuel injection system comprising a fuel pressure boost pump having a pump body that defines a pump cylinder and a pump chamber, a piston structure in the pump cylinder, a fuel inlet conduit in flow connection with the pump chamber, the fuel inlet conduit being provided with a first one-way valve, and a fuel outlet conduit in flow connection with the pump chamber, the fuel outlet conduit being provided with a second one-way valve, the method comprising driving the piston structure to move in the pump cylinder for executing alternately a suction stroke, in which fuel flows into the pump chamber by way of the first one-way valve, and a pressure stroke, in which fuel flows from the pump chamber by way of the second one-way valve, and measuring the temperature of the pump body.

9. A method according to claim 8, comprising measuring rate of change of the temperature of the pump body, comparing the rate of change of the temperature of the pump body with a preset maximum value, and activating an alarm in the event that the measured rate of change exceeds the preset maximum value.

10. A method according to claim 8, wherein the fuel injection system comprises a plurality of fuel pressure boost pumps each having a pump body, and the method comprises measuring the temperature of each pump body, comparing the temperature of a first pump body with the temperature of a second pump body, and activating an alarm in the event that the measured temperature of the first pump body exceeds the measured temperature of the second pump body by a preset amount.

11. A method according to claim 10, comprising measuring the temperature of each pump body at regular intervals.

12. A method according to claim 8, comprising measuring the temperature of the pump body at regular intervals.

* * * * *